United States Patent [19]

Strickland

[11] 4,282,279

[45] Aug. 4, 1981

[54] FORMABLE REMOVABLE INSULATING ENCLOSURE FOR A CONTAINER

[75] Inventor: Robert D. Strickland, Santa Barbara, Calif.

[73] Assignee: Rip 'n Rap, Inc., Santa Barbara, Calif.

[21] Appl. No.: 85,371

[22] Filed: Oct. 16, 1979

[51] Int. Cl.[3] ..... B32B 3/06; B65D 75/00

[52] U.S. Cl. ..... 428/101; 428/102; 428/99; 428/157; 428/315; 206/139; 215/13 R; 215/12 A; 150/52 R; 229/91; 220/DIG. 9; 220/3.1

[58] Field of Search ..... 2/DIG. 6, 243 B, 271; 428/99-102, 157, 315; 252/62; 220/3.1, 901, 902, DIG. 9; 206/810; 229/91, DIG. 9; 215/12 A, 13 R

[56] References Cited

U.S. PATENT DOCUMENTS

| | | | |
|---|---|---|---|
| 1,949,677 | 3/1934 | Crawford | 215/12 A |
| 2,974,814 | 3/1961 | Parsons et al. | 215/13 R |
| 3,086,529 | 4/1963 | Munz et al. | 2/DIG. 6 |
| 3,285,455 | 11/1966 | Pewitt | 220/902 |
| 3,285,456 | 11/1966 | Pewitt | 220/902 |
| 3,501,774 | 3/1970 | Norman | 2/DIG. 6 |
| 3,581,883 | 6/1971 | Whitney | 229/3.5 X |
| 3,941,159 | 2/1976 | Toll | 138/147 |
| 3,963,199 | 6/1976 | Pravaz | 428/100 X |
| 3,999,521 | 12/1976 | Puiello | 428/100 X |
| 4,181,765 | 1/1980 | Harmony | 215/13 R |

*Primary Examiner*—P. C. Ives
*Attorney, Agent, or Firm*—Daniel J. Meaney, Jr.

[57] ABSTRACT

A formable removable enclosure for a container wherein the container has a top, bottom and geometrically shaped exterior outer surface, the enclosure having a pliable elongated substantially rectangular shaped covering member adapted to be positioned and formed around the exterior outer surface of the container and having a pair of planar opposed spaced protective layers which terminate in opposed ends and wherein the covering member has a width substantially equal to the geometrical dimension between the top and bottom of the container and a length which is greater than the geometrical dimension around the periphery of the exterior of the exterior outer surface to enable the edge of one of the opposed ends of the covering member to contact and overlap with the edge of the other end of the covering member when the covering member is positioned and formed around the container, a resilient insulating layer positioned between the pair of spaced opposed protective layers of the covering member which is adapted to be positioned and formed around the periphery of the container with one of the protective layers of the covering member being positioned between the insulating layer and the container, a pair of fastening means one of which is located on the edge of one of the ends of the protective layers and the other fastening means, which is adapted to make fastening engagement with the one fastening means, being located on the edge of the other end of the protective layer and on the side opposite to that of the one fastening means such that the pair of fastening means cooperate with each other to hold the covering member in a tight snug fitting relationship around the container to insulate the same from the environment as shown.

15 Claims, 15 Drawing Figures

FORMABLE REMOVABLE INSULATING ENCLOSURE FOR A CONTAINER

BACKGROUND OF THE INVENTION

1. Field of the Invention

This invention relates to an insulating enclosure for a container and more particularly to a formable removable insulating enclosure for a container wherein the container may comprise any geometrical shape and contains a substance which has a desired temperature other than the ambient temperature of the environment for insulating the container and substance therein to maintain the same at within a desired temperature range for a reasonable period of time.

2. Disclosure of the Prior Art

It is known in the prior art to insulate a container to maintain a liquid or food at a pre-established warm or cold temperature. One known prior art class of devices is generally known as insulated vacuum bottles. The prior art vacuum bottles are formed with an interior cavity in the form of a glass bottle having sealed inner and outer glass containers which define an evacuated chamber between the two glass containers. The evacuated chamber reduces heat transfer for the substance and inner glass container to the exterior of the glass container. A shock resistant housing, which is integral with and forms part of the entire insulated container, is used to hold and support the evacuated glass bottle to prevent breakage thereof due to abrupt forces applied to the exterior of the container, droppage of the container, or exposure of the container to other external forces such as vibrations, which would jar or otherwise destroy or damage the glas container.

Also, insulated drinking containers are known in the art. One known container is formed of an inner housing and a slightly larger exterior housing which are assembled into an integral unit having an insulating layer of material therebetween. The assembled unit is joined or sealed to form an insulated integral container into which a hot or cold substance, such as fluid or food, can be deposited and stored therein to maintain the temperature of the same within a desired temperature range of the substance relative to that of the environment for a reasonable period of time.

Other devices are known in the art wherein the insulating housing is not integral with the container. These include such devices as styrofoam holders and ceramic holders. Typically, a container, such as a can containing a soft drink or other carbonated or non-carbonated beverage, is chilled and then inserted into an insulated cup or enclosure which receives and holds the container.

In addition, other beverage containers for wine, champagne and kegs of beer have been insulated by wrapping the same in a blanket or other insulator material formed into a holder, or placing the same in a tub or bucket containing ice or cold water to maintain the temperature within a desired temperature range at other than the temperature of the environment.

SUMMARY OF THE INVENTION

The present invention overcomes certain of the problems of the prior devices by use of a new, novel and unique series of formable removable insulating enclosures adapted for use with a variety of containers having a plurality of geometrical shapes and sizes.

Briefly, the present invention comprises a formable removable insulating enclosure for a container wherein the container has a top, bottom and a geometrically shaped exterior outer surface. The formable removable insulating enclosure has a pliable elongated substantially rectangular shaped covering member which is adapted to be positioned and formed around the exterior outer surface of a container. The covering member has an outer protective layer which terminate in opposed ends. The covering member has a width substantially equal to the geometrical dimension between the bottom surface and top surface of a container to be enclosed thereby. The covering member has a length which is greater than the geometrical dimension around the periphery of the exterior outer surface of the container to enable the edge of one of the opposed ends of the covering member to contact and overlap with the edge of the other end of the covering member when the covering member is positioned and formed around the container. A resilient insulating layer is integral with the covering member. The insulating layer is adapted to be formed around the periphery of the container with outer layer of the covering member. A pair of fastening means is adapted to make removable locking engagement with each other. One of the fastening means is located on the edge of one of the ends of the covering member and extends along the width thereof and is positioned to be located in a plane substantially parallel to and spaced from the periphery of the exterior outer surface of the container. The other of the fastening means is located on the edge of the other end of the covering member and on the side opposite to that of the one fastening means. The covering member is adapted to be positioned and formed around the exterior outer surface of the container and to be pulled tightly therearound to cause the inner layer of the covering member to become intimately engaged with the exterior outer surface of the container such that the pair of fastening means engages and cooperates with each other to hold the covering member in a tight, snug fitting relationship around the container to insulate the same from the environment.

In the known prior vacuum bottle containers, it is necessary to preheat or precool the container before placing the preheated or precooled fluid, beverage, food or substance therein in order to obtain the most efficient insulating of the device. If the vacuum bottle is not preheated or precooled, then the inner glass liner absorbs some of the heat from the heated substance which results in the loss of heat and reduced temperature. Likewise, if the substance which is placed in the inner glass liner is precooled and the glass liner or container is at ambient temperature of the environment, then heat will be transferred from the higher temperature container to the substance which results in the temperature thereof being increased thereby resulting in the substance being raised closer to ambient temperature. Also, such containers are bulky, require cleaning and special handling to avoid breakage. In addition, if a beverage such as champagne or other similarly packaged or bottled beverage is desired to be insulated to maintain its temperature over a reasonable range and period of time, the use of a vacuum bottle is inappropriate.

The use of individual drinking containers wherein the fluid holder and the insulating housing are an integral unit has disadvantages similar to that of the vacuum bottles described above.

The use of styrofoam holders requires that the insulating devices be preformed into a shape that is adapted to accommodate the shape of the container to be inserted therein. When not in use, such holders are bulky and require the same volume of storage space whether the device includes or excludes a container to be enclosed thereby. Also, styrofoam is a relatively soft and easily damaged material which can easily be bent, broken or otherwise deformed. Further, unless the styrofoam is sealed or precoated with a fluid-resistant coating, fluid, which comes in contact therewith, is absorbed thereby which results in a wet enclosure or less efficient insulating of the enclosure. Further, if the temperature of the environment is below freezing and fluid is absorbed by the holder, the fluid may freeze and rupture or otherwise damage the enclosure.

The formable removable insulating enclosure of the present invention has several advantages over the prior art devices. One advantage is that the enclosure is formed of a pliable formable covering member having a resilient insulating layer. The insulating enclosure, when not in use, can be flattened and stored. When in use, the insulating enclosure is easily positioned and formed around the container to enclose and insulate the same. After use, the insulating enclosure can be easily removed.

The pliable formable removable insulating enclosure of the present invention, when positioned and formed around the container, is held in place tightly against the exterior outer surface of the container by use of a pair of fastening means. In the preferred embodiment, one fastening member has a plurality of hook-like removable members which engage and are firmly held in place by the other fastening means which has a soft, tough extended pile-like member which is engaged by and held by the hook-like fastening members. Thus, the insulating enclosure can be easily installed by urging the two fastening members into engagement and cooperation with each other to form a secure and positive fastening arrangement therebetween. The insulating enclosure can be easily removed from the container by urging the two fastening means apart which separates the hook-like removable members from the soft, tough extended pile-like members.

Another advantage of the present invention is that the insulating enclosure can accommodate a large variety of geometrical shapes and dimensions by designing the enclosure for such container. Examples of such containers range from cans or bottles of soft drinks, cans or bottles of beer, bottles of wine, champagne or specially designed beverage containers, for example, containers used to store a supply of drinking water on a bicycle, or large volume containers such as kegs of beer or the like.

DESCRIPTION OF THE PREFERRED EMBODIMENT

These and other advantages and features of the present invention can be more easily understood from the following more detailed description of the preferred embodiments taken in conjunction with the accompanying drawing in which.

DESCRIPTION OF THE PREFERRED EMBODIMENT

Figure 1:
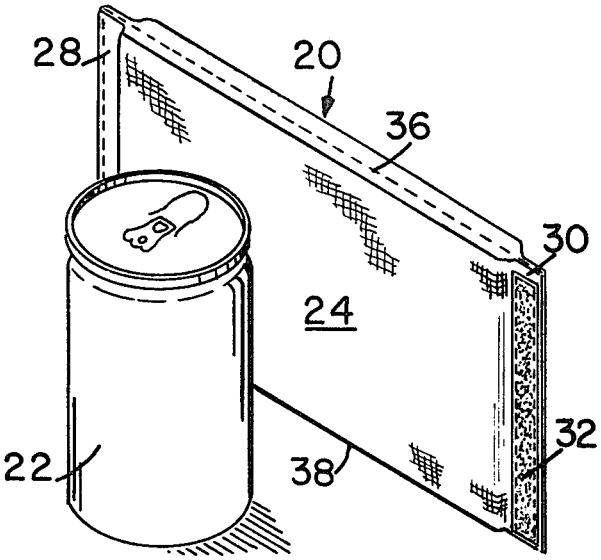
FIG. 1 is a perspective view showing a container and a formable removable insulating enclosure of the present invention.

FIG. 1 depicts a formable removable insulating enclosure 20 and a container 22 wherein the container 22 has an exterior outer surface of a predetermined geometrical shape and dimension, such as in the form of a thin walled cylinder. The container 22 has a bottom surface and an aligned top surface to define a cavity in the center thereof. The cavity is adapted to have a substance stored therein such as a beverage or the like, which beverage can be preheated or precooled to a temperature other than ambient temperature of the environment.

Typically, a substance at a temperature other than the ambient temperature of the environment is deposited in the cavity. It is desired to maintain the preheated or precooled state for a reasonable period of time, such as several hours.

The formable removable insulating enclosure 20 is adapted to enclose the container 22. The insulating enclosure 20 has a pliable, elongated substantially rectangular shaped covering member 24 which is adapted to be positioned and formed around the exterior outer surface of the container 22. The covering member 24 may be formed of a pair of planar spaced opposed sides or protective layers which terminate in opposed ends. The covering member 24 has a width substantially equal to the geometric dimension between the bottom surface and top surface of the container 22 to be enclosed thereby. The covering member 24 has a length which is greater than the geometrical dimension around the periphery of the exterior outer surface of the container 22 to enable the edge of one of the opposed ends 28 of the covering member 24 to contact and overlap with the edge of the other end 30 of the covering member 24 when the same is positioned and formed around the container 22.

Figure 3:
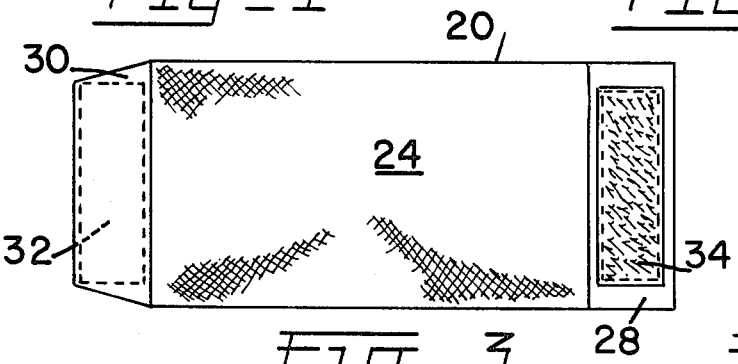
FIG. 3 is a front plan view of a formable removable insulating enclosure showing one of two fastening members.
Figure 4:
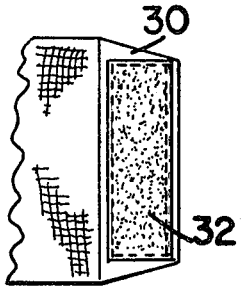
FIG. 4 is a partial front plan view of the opposite side of the formable removable insulating enclosure shown in FIG. 3 showing the other of the two fastening members.

The covering member 24 has a pair of fastening means 32 and 34. Fastening means 34 is shown in FIG. 3, and fastening means 32 is shown in FIG. 4. The fastening means 32 and 34 are adapted to make removable locking engagement with each other. The first fastening means 32 is located on end 30 of the covering member 24 and extends along the width thereof. Fastening means 32 is located on end 30 of the covering member 24 and likwise extends along the width thereof.

Figure 2:
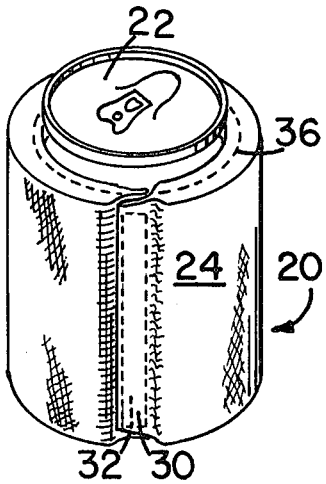
FIG. 2 illustrates a container having a formable removable insulating enclosure therearound.

As shown in FIG. 2, the first fastening means 32 extends along the width of the covering member 24 and is positioned to be located in a plane substantially parallel to and spaced from the periphery of the external outer surface of the container 22.

The second fastening means 34, which is adapted to make removable locking engagement with the first fastening means 32, is located on the edge of the other end 28 of the covering member 24 and extends along the width thereof. Also, as shown in FIG. 3, the second fastening means 34 is substantially parallel to the first fastening means 32, but is located on the side opposite to that of the first fastening means 32 on the covering layer 24.

FIG. 3 illustrates in greater detail that the first fastening 32 is located along the edge of end 30 on one side of the covering member 24, and the second fastening means 34 is likewise positioned on the end 28 of the covering member 24, but is located on the side opposite to that of the first fastening means 32.

FIGS. 3 and 4 illustrate the preferred embodiment for the first fastening means 32 and the second fastening means 34. Specifically, and for purposes of example only, the preferred embodiment of the first fastening means 32 is formed of a plurality of small hook-like removable members, and the second fastening means 34 is formed of a soft, tough extended pile-like fabric member adapted to be engaged by and held securely by the plurality of hook-like removable members of the first fastening means 32. The fastening means 32 and 34 in the preferred embodiment uses VELCO brand fastening means which is used in the art. It is envisioned that other releasable fasteners may be used such as strip members with adhesives; snaps, fasteners having a hold and pin arrangement wherein the pin from one edge extends through an aperture formed on the other edge, or the like.

In the embodiment, illustrated in FIGS. 3 and 4, the end 28 has a relatively square corner while the end 30 has tapered upper and lower corners. The purpose for the type of construction is to permit the first fastening means 32 to be located on the exterior of the container as illustrated in FIG. 2.

Figure 5:
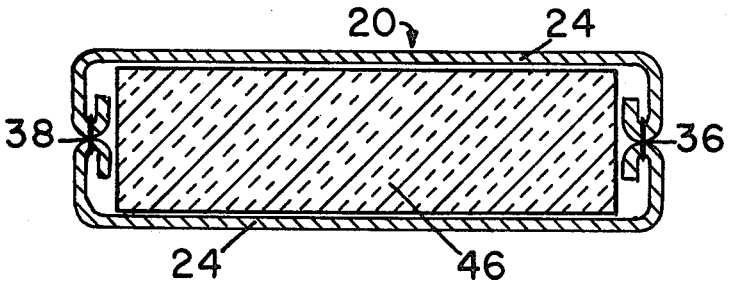
FIG. 5 is a diagrammatic cross-sectional view showing the relationship between a covering member having a pair of planar outer layers and a resilient insulating layer positioned therebetween.

FIG. 5 shows the construction of the covering member 24 in its preferred embodiment. The covering member 24 comprises a pair of planar spaced opposed protective layers shown as 24. The outer protective layers 24 are joined along the top edge as depicted by seam 36 and along the bottom edge as depicted by seam 38. In the preferred embodiment, the outer protective layers 24 are formed of a nylon material which is selected because it is impervious to fluids and other beverages while protecting the surface thereof and to make the interior thereof essentially watertight. The outer protective layers 24 define a space or cavity therebetween which is adapted to receive a resilient insulating layer 46. The resilient insulating layer 46 is positioned within the space between the planar spaced opposed protective layers 24 defining the covering member 24 and essentially fills the area or cavity therebetween. In FIG. 3, the geometrical dimension of the cavity extends lengthwise between the ends 28 and 30 and has a width equal to that of the covering member. The insulating layer 46 is adapted to be formed around the periphery of the container such that one of the protective layers 24 of the covering member is psoitioned between the insulating layer 46 and the exterior outer surface of a container 22. In the preferred embodiment, the resilient insulating layer is formed of polyurethane foam material.

As an alternative, it is envisioned that the resilient insulating layer 46 could be formed of an insulating material with the surface thereof defining the outer layer. Also, the surface may be coated with a chemical or other appropriate layer to form a protective layer. Also, it is envisioned that the fastening means 32 and 34 could be attached directly to the insulating layer with or without the outer protective layer extending into the area of the fastening means 32 and 34.

Figure 6:
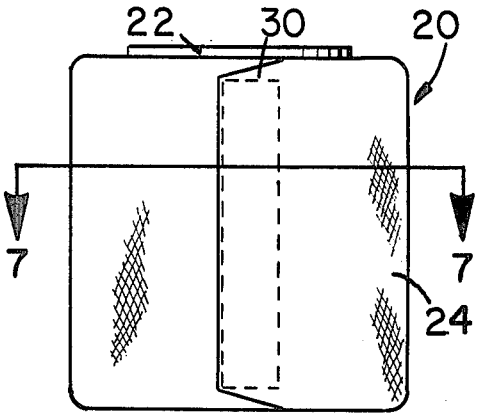
FIG. 6 is a front plan view of a formable removable insulating enclosure and container.

FIG. 6 shows in the front plan view the relationship between a formable removable insulating enclosure 24 when it encloses a container 22 such that the covering member is adapted to be positioned and formed around the exterior outer surface of the container 22. The enclosure 24 is pulled tightly around the container 22 by the fastening means 32 and 34 to cause the covering member 24 to be intimately engaged with the exterior outer surface of the container 22.

Figure 7:
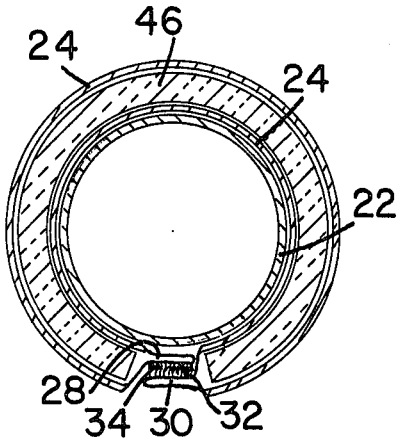
FIG. 7 is a section taken along section line 7—7 of FIG. 6.

FIG. 7 shows, in section, the construction and relationship between the covering member and the container. In FIG. 7, the formable removable insulating enclosure is formed into a pliable elongated substantially rectangular shaped covering member which is adapted to be positioned to form around the exterior outer surface of the container 22. In the preferred embodiment shown as FIG. 7, the covering member has a pair of planar spaced opposed protective layers 24 which terminate in opposed ends 28 and 30. End 30 supports the first fastening means 32 which is in the form of hook-like removable members and the second fastening means 34 which is in the form of a soft, tough extended pile-like fabric member. The resilient insulating layer 46 is positioned within the space between the pair of planar spaced opposed protective layers 24. The insulating layer 46 is adapted to be formed around the periphery of the container 22 with one of the protective layers 24 being positioned between the insulating layer 46 and the exterior outer surface of the container 22.

Figure 8:
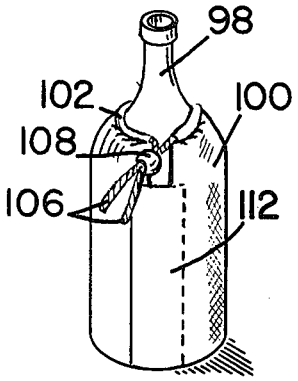
FIG. 8 is a pictorial representation of a champagne bottle having a formable removable insulating enclosure therearound.
Figure 9:
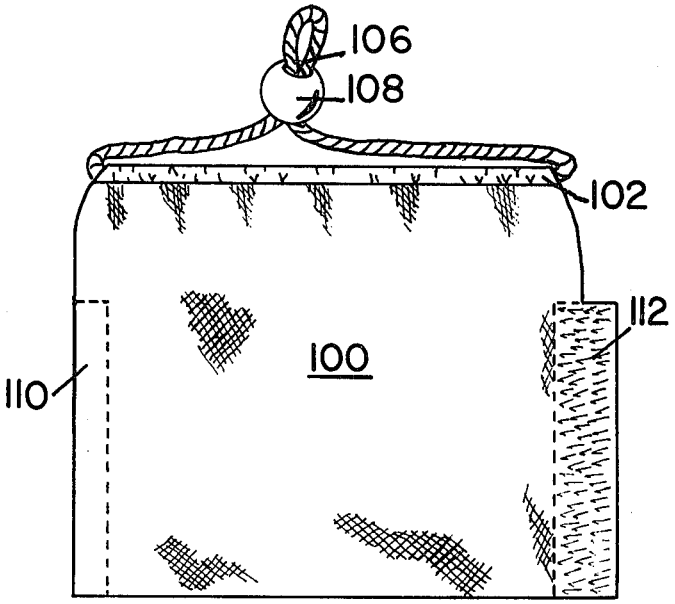
FIG. 9 is a front plan view of a formable removable insulating enclosure adapted for use with a champagne container or a wine container.

FIG. 8 illustrates a formable removable insulating enclosure adapted for enclosing a bottle-shaped container having elongated top and a bottom. The bottle-shaped container 98 may be a bottle of champagne or wine which has pre-cooled for drinking. FIG. 9 shows, in a plan view, the geometrical shape of the formable removable insulating enclosure adapted for use with a bottle-shape container.

In FIGS. 8 and 9, the formable removable insulating enclosure concludes a pliable elongated substantially rectangular shaped covering member 100 having arcuate shaped deflections along the corners thereof which are adapted to be positioned adjacent the elongated top of the bottle-shaped container 98. The covering member 100 has an external outer layer defining a cavity therein and terminates in a pair of opposed ends. The opposed ends extend from the arcuate shaped deflection of the covering member 100 adjacent to the elongated top of the container 98 to the other corners defining the bottom of the covering member 100. The covering member 100 has a width substantially equal to the height of the bottle-shaped container 98 extending from the elongated top of the container to the bottom thereof. The covering member 100 has a length which is greater than the geometrical dimension around the periphery of the exterior outer surface of the bottle-shaped container 98. The length is selected to enable the edge of one of the opposed ends of the covering member 100 to contact and overlap with the edge of the other end of the covering member when the covering member is positioned around and formed around the bottle-shaped container 98.

A resilient insulating layer is positioned within the cavity defined by the external outer layer of the covering member and is selected to be of a material adapted to be formed around the periphery of the bottle-shaped container 98, the assembly of which is similar to that shown in FIG. 5.

A first fastening means 112 includes a support means located on and extending from the edge of one of the ends of the covering member 100. The first fastening means 112 extends along the width of the covering member 10 and extends from approximately the end of the arcuate-shaped deflection at the end adjacent to the elongated top of the bottle-shaped container and extends to the corner adjacent to the bottom of the container 98. The fastening means 112 is positioned to be located in a plane substantially parallel to and spaced from the periphery of the exterior outer surface of a bottle-shaped container 98 in the embodiment illustrated in FIG. 8.

A second fastening means 110 is adapted to make removable locking engagement with the first fastening means 112 and is located on the edge of the other end of the covering member 98 and extends along the width thereof from approximately the end of the arcuate-shaped deflection located adjacent to the elongated top of the bottle-shaped container 98 to the bottom of the bottle-shaped container 98. The second fastening means 110 is substantially parallel to the first fastening means and is located on the side opposite to that of the first fastening means 112 including its support means.

An elongated passageway 102 extends along the elongated side of the covering member 100 adjacent to the elongated top of the bottle-shaped container 98. An elongated tying member 106 is positioned in the elongated passageway 102 and extends therefrom. The elongated tying member 106 may include a slideable clasp 108 which is adapted to cooperate with the elongated passageway 102. The tying member 106 when pulled relative to the passageway 102 causes the elongated side of the covering member 100 to be urged into a tight curved relationship against the elongated top of the bottle-shaped container 98. The covering member 100 together with the first fastening means 112 and the second fastening means 110 is adapted to pull the covering member 100 tightly around the container 98 to cause the covering member 100 to be tightly urged against the exterior outer surface of the bottle-shaped container 98 to insulate the same from the environment.

Figure 10:
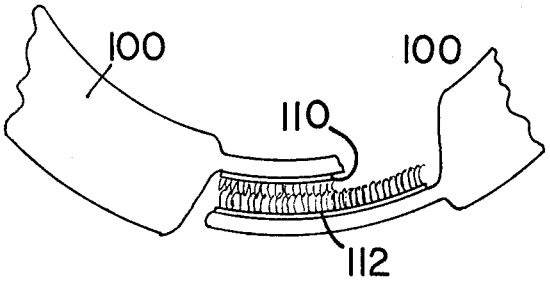
FIG. 10 is a pictorial representation of the interconnection between two fastening means of the formable removable insulating enclosure of FIG. 9 used for a large container.
Figure 11:
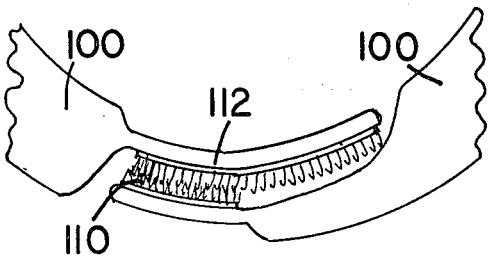
FIG. 11 is a pictorial representation of the interconnection between two fastening means of the formable removable insulating enclosure of FIG. 9 used for a small container.

FIGS. 10 and 11 illustrate the reversible feature and capability of the enclosure illustrated in FIGS. 8 and 9. The embodiment illustrated in FIG. 10 is adapted to use with a bottle having a larger diameter such as a champagne bottle. In the embodiment illustrated in FIG. 10, the first fastening means 112, which includes a plurality of hook-like removable members, cooperates with a second fastening means 110 which is formed of a soft, tough extended pile-like fabric member. A selected portion of the second fastening means 110 cooperates with the end of the hook-like removable members of the first fastening means to provide the necessary clamping action to hold the covering member 100 securely around the bottle 98. If a bottle-shaped container has a smaller diameter, the covering member 100 can be reversed such that the first fastener means 112 are located against the exterior outer surface of the bottle. The second fastening means 110 are moved to the farthest end of the support means to engage a selected portion of the hook-like removable members to form a tight clamping relationship therebetween.

Figure 12:
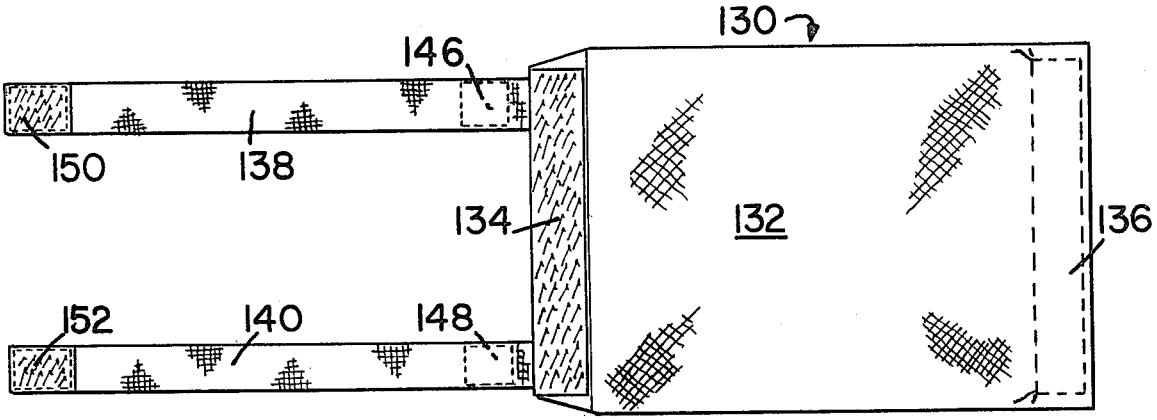
FIG. 12 is a front plan view of a formable removable insulating enclosure adapted for use for insulating and holding a water supply bottle on a bicycle.
Figure 13:
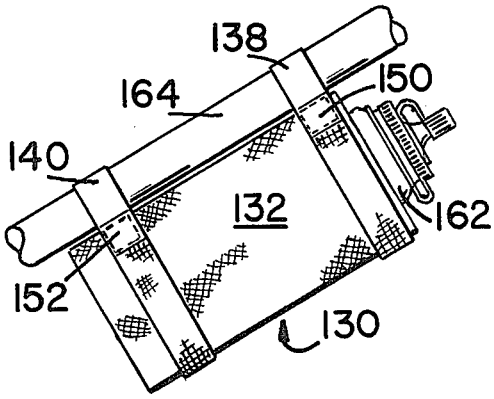
FIG. 13 is a pictorial representation of a water supply bottle enclosed by a formable removable insulating enclosure which is supported by a bycycle frame.

FIGS. 12 and 13 show another embodiment of a form able removable insulating enclosure designated as insulating enclosure 130. In the insulating enclosure 130 of FIGS. 12 and 13, the covering member 132 has a pair of fastening means 134 and 136 which are adapted to cooperate with each other and are located on the covering member in an arrangement similar to that as earlier described therein. In addition, a first and second elongated strap 138 and 140 extend from the edge of a selected end of the covering member 132 and in a space parallel relationship to each other. A first pair of strap fastening means 146 and 148 on straps 150 and 152, respectively, are located on the exterior surface of each of the elongated straps adjacent the selected end of the covering member. The strap fastening means 150 and 152 are positioned on the surface of the elongated straps 138 and 140, respectively, and on the surface thereof which is opposite to that of the selected end of the covering member containing one of the pair of fastening means such as fastening means 134 on covering member 132.

A second pair of strap fastening means 150 and 152 are located on the first and second elongated straps 138 and 140 respectively. Each of the second pair of strap fastening means 150 and 152 are located on the surface of each elongated strap which is on the same side as the surface of the covering member 132 containing one of the pair of the fastening means such as the fastening means 134. The first pair of strap fastening means 146 and 148 are adapted to cooperate and removably engage with the second pair of strap fastening means 150 and 152, respectively, in order to removably support a container, such as, for example, a water supply bottle 162, from a support 164 such that the container 162 and the enclosure 130 are supported from the support 164 by the elongated straps 138 and 140.

Figure 15:
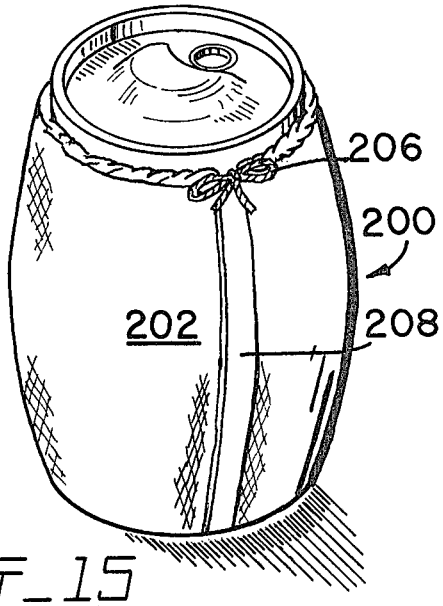
FIG. 15 is a pictorial representation of a beer keg having a formable removable insulating enclosure of FIG. 14 therearound.
Figure 14:
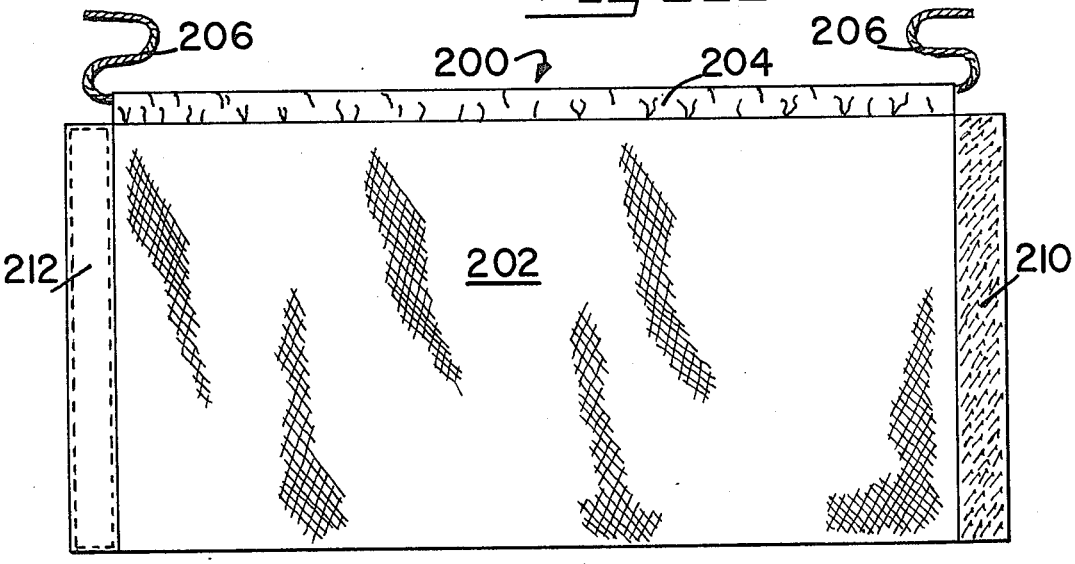
FIG. 14 is a front plan view of a formable removable insulating enclosure having two elongated fastening means and a tying member for urging the insulating enclosure against the top of a container.

FIG. 14 shows another embodiment of a large sized formable removable insulating enclosure 200 which is adapted to enclose a beer keg as illustrated in FIG. 15. The formable removable insulating enclosure 200 includes a covering member 202 having a first fastening means 210 and a second fastening means 212. The fastening means 210 and 212 are located at the opposed ends thereof as earlier described herein. Means defining a passageway 204 is located along the elongated side of the covering member 202. The passageway 204 is adapted to have a tying member 206 located therein. In the embodiment of FIG. 14, all of the corners of the substantially rectangular-shaped covering member 202 are square. In the embodiment of FIG. 14, the means defining a passageway 204 extends along one side of the covering member and extends between the interior edges of the fastening means 210 and 212.

As shown in FIG. 15, when the formable removable insulating enclosure 200 is mounted on the beer keg, the end 208 containing the first fastening means 210 is in fastening engagement with the second fastening means 212. The fastening means 210 and 212 hold the covering member 202 tightly therearound. The tying member 206 is then pulled which causes the top portion of the covering member 202 to be urged into intimate tight engagement with the top section of the container or beer keg as illustrated in FIG. 15. The enclosure 202 is able to keep the predetermined temperature of the beer contained in the keg within a selected temperature range for several hours.

A method of using the formable removable enclosure of the present invention includes the steps of positioning and forming the enclosure around the container, overlapping the edges of the covering member and urging the fastening means into fastening engagement. The step of pulling and tying the tying member through the passageway urges the top of the covering member against the container.

The use of a formable removable insulating enclosure as disclosed herein has been described for several applications wherein a substance within a container is precooled and the insulating enclosure is intended to maintain the predetermined temperature within a selected temperature range at other than ambient temperatures for a reasonable period of time. It is also envisioned that the substance in the container could be preheated to a desired temperature and the insulating enclosure would likewise maintain that temperature within a selected temperature range at other than an ambient temperature for a reasonable period of time.

The formable enclosures can be used in other applications such as, for example, maintaining the temperature of blood plasma, medical solutions and the like. Also, the shape of the covering member itself could be in a wide variety of geometric arrangements, the significant factor being the geometrical shape and dimension of the exterior outer surface of the container to be insulated thereby.

The materials disclosed herein are typical of materials which could be used in practicing this invention.

It is anticipated that the protective layer can be formed of any one of a number of materials such as plastic, cloth or the like. In addition, the resilient insulating layer can be formed of any number of insulating material including fabric type insulating materials, foam type insulating materials or small insulating beads of styrofoam or the like. Also, any one of a number of fastening means may be utilized in place of the VELCO-type fasteners which are used in the preferred embodiment.

It is also envisioned that a substance deposited within the cavity of the container could be other than a beverage or food substance. For example, it is envisioned that the substance to be placed therein could be a heated material adapted for use in special applications such as medical applications, industrial applications or the like.

What is claimed is:

1. A formable removable insulating enclosure for a container comprising a pliable elongated covering member adapted to be positioned and formed around the exterior outer surface of a said container, said covering member having an outer layer which terminates in opposed ends and wherein said outer layer of the covering member is formed of two separate protective layers which are joined around the periphery thereof, a width substantially equal to the height of a said container to be enclosed thereby and a length which is greater than the geometrical dimension around the periphery of the exterior outer surface of a said container so as to enable the edge of one of the opposed ends of the covering member to contact and overlap with the edge of the other end of the covering member when the covering member is positioned and formed around a said container;

a resilient insulating layer enclosed by the outer layer of said covering member, said insulating layer being adapted to be formed around the periphery of a said container together with the outer layer of the covering member;

a first fastening means located on one edge of a selected end of the covering member and extending substantially along the width thereof and positioned to be located in a plane substantially parallel to and spaced from the periphery of the exterior outer surface of a said container; and a second fastening means adapted to make removable locking engagement with the first fastening means, said second fastening means being located on the edge of the other end of the covering member and extending substantially along the width thereof and positioned to be located in a plane substantially parallel to said first fastening means;

said covering member being adapted to be positioned and formed around the exterior outer surface of the container and to be pulled tightly therearound to cause the covering member to be intimately engaged with the exterior outer surface of a said container such that said pair of fastening means engage and cooperate with each other to hold said covering member in a tight snug fitting relationship around a said container to insulate the same from the environment.

2. The formable removable insulating enclosure of claim 1 wherein said first fastening means is formed of a plurality of small hook-like removable members; and said second fastening means is formed of a soft, tough extended pile-like fabric member which is adapted to be engaged by and held securely by the plurality of hook-like removable members, said hook-like removable members and said extended pile-like fabric member being adapted to engage each other in a tight clamping relationship when the hook-like removable members are urged into intimate engagement with the extended pile-like fabric member and being adapted to be separated therefrom in response to a separation force which withdraws and separates the hook-like removable members from the extended pile-like fabric member.

3. The formable removable insulating enclosure of claim 1 further comprising means defining a passageway along one elongated side of the covering member which is adapted to be positioned adjacent the top of a said container; and a tying member located within and extending from said means defining a passageway and adapted to urge the elongated edge of the covering member into tight, intimate engagement with a said container when the covering member is held in a tight snug fitting relationship around the exterior outer surface of a said container.

4. The formable removable insulating enclosure of claim 3 wherein the first fastening means and the second fastening means extend along the entire width of the covering member and wherein said means defining a passageway extends along one edge of the covering member and extends between the interior edges of the fastening means.

5. The formable removable insulating enclosure of claim 1 further comprising a first and second elongated strap extending from the edge of a selected end of the covering member and in a spaced parallel relationship to each other;

a first pair of strap fastening means one of which is located on the exterior surface of each elongated strap adjacent said selected end of the covering member and positioned on the surface of the elongated strap which is opposite to the surface of the selected end of the covering member containing one of the pair of fastening means;

and a second pair of strap fastening means one of which is located on the exterior surface of the end of each elongated strap, said second pair of strap fastening means being located on the surface of each elongated strap which is on the same side as the surface containing one of the pair of said fastening means, said first pair of strap fastening means and second pair of strap fastening means being adapted to cooperate and removably engage each other to support a said container and the enclosure from a support while the enclosure encloses a said container therein.

6. The formable removable insulating enclosure of claim 5 wherein said covering member is adapted to enclose a water supply bottle and wherein said elongated straps are adapted to removably support an enclosed water supply bottle around the frame of a bicycle.

7. The formable removable insulating enclosure of claim 5 wherein said covering member is adapted to enclose a water supply bottle and wherein said elongated straps are adapted to removably support an enclosed water supply bottle around the frame of a bicycle.

8. A formable removable insulating enclosure adopted for enclosure a bottle-shaped container having an elongated top and a bottom, said insulating enclosure comprising a pliable elongated substantially rectangular shaped covering member having arcuate shaped deflections along the corners thereof adapted to be positioned adjacent the elongated top of a said bottle-shaped container, said covering member having an external outer layer defining a cavity therein, formed of two separate protective layers which are joined around the periphery thereof said covering member exterior outer layer terminating in a pair of opposed ends which extend from the arcuate shaped deflections of the covering member adjacent to the elongated top of a said container to the other corners defining said covering member, said covering member having a width substantially equal to the height of a said bottle-shaped container extending from the elongated top of a said container to the bottom thereof, said covering member having a length which is greater than the geometrical dimension around the periphery of the exterior outer surface of a said bottle-shaped container to enable the edge of one of the opposed ends of the covering member to contact and overlap with the edge of the other end of the covering member when the covering member is positioned around and formed around a said bottle-shaped container;

a resilient insulating layer positioned within the cavity defined within the external outer layer of the covering member, said insulating layer being adapted to be formed around the periphery of a said bottle-shaped container;

a first fastening means including a support means located on and extending from the edge of one of the ends of the covering member and extending along the width thereof from approximately the end of the arcuate shaped deflection at the end adjacent to the elongated top of a said bottle-shaped container and extending to the corner adjacent the bottom of a said bottle-shaped container and positioned to be located in a plane substantially parallel to and spaced from the periphery of the exterior outer surface of a said bottle-shaped container;

a second fastening means adapted to make removable locking engagement with the first fastening means and which is located on the edge of the other end of the covering member and extending along the width thereof from approximately the end of the arcuate shaped deflection located adjacent to the elongated top of a said bottle-shaped container to the other corner of the covering member adjacent the bottom of the bottle-shaped container and substatially parallel to the first fastening means, said second fastening means being located on the side opposite to that of the first fastening means and support means;

an elongated passageway extending along the elongated side of the covering member adjacent to the elongated top of a said bottle-shaped container; and an elongated tying member positioned in said elongated passageway and extending therefrom, said elongated tying member being adapted to cooperate with said elongated passageway to cause the elongated passageway and elongated side of the covering member to be urged into a tight curved relationship against the elongated top of a said bottle-shaped container to intimately urge the elongated edge of the covering member against the exterior outer surface of the elongated top of a said bottle-shaped container; said covering member being adapted to being positioned and formed around the exterior outer surface of a said bottle-shaped container and adapted to be pulled tightly therearound to cause the covering member to be tightly engaged with the exterior outer surface of a said bottle-shaped container to insulate the same from the environment.

9. A formable removable insulating enclosure for a container adapted to insulate the same from the environment, said container having an exterior outer surface of a predetermined geometrical shape and dimension, a bottom surface and an aligned top surface, said container defining a cavity in the center thereof which is adapted to have a substance having a temperature other than ambient temperature of the environment deposited in the cavity of the container, said insulating enclosure comprising a pliable elongated substantially rectangular shaped covering member adapted to be positioned and formed around the exterior outer surface of a said container, said covering member having a pair of planar spaced opposed protective layers which terminate in opposed ends, said covering member having a width substantially equal to the geometrical dimension between the bottom surface and top surface of a said container to be enclosed thereby, said covering member having a length which is greater than the geometrical dimension around the periphery of the exterior outer surface of the container to enable the edge of one of the opposed ends of the covering member to contact and overlap with the edge of the other end of the covering member when the covering member is positioned and formed around a said container;

a resilient insulating layer positioned within the space between said pair of planar spaced opposed protective layers of said covering member, said insulating layer being adapted to be formed around the periphery of a said container with one of the protective layers of the covering member being positioned between the insulating layer and the exterior outer surface of a said container;

a first fastening means located on one edge of one of the layers of the covering member and extending along the width thereof and positioned to be located in a plane substantially parallel to and spaced from the periphery of the exterior outer surface of a said container;

a second fastening means adapted to make removable locking engagement with said first fastening means and located on the edge of the other end of the covering member and extending along the width thereof and substantially parallel to the first fastening means, said second fastening means being located on the side opposite to that of said first fastening means; and said covering member being adapted to be positioned and formed around the exterior outer surface of a said container and to be pulled tightly therearound to cause the inner layer of the covering member to become intimately engaged with the exterior outer surface of a said container such that said first fastening means and said second fastening means engage and cooperate with each other to hold said covering member in a tight snug fitting relationship around a said container to insulate the same from the environment.

10. A formable removable insulating enclosure for a container comprising a pliable elongated covering member formed of two separate protective layers which are joined around the periphery thereof including a resilient insulating layer adapted to be positioned and formed around the exterior outer surface of the said container, said covering member having a width substantially equal to the height of a said container to be enclosed thereby and length which is greater the geometrical dimension around the periphery of the exterior outer surface of a saod container so as to enable the edge of one of the opposed ends of the covering member to contact and overlap with the edge if the other end if the covering member when the covering member is positioned and formed around a said container;

a first fastening means located on one edge of a selected end of the covering member and extending substantially along the width thereof and positioned to be located in a plane substantially parallel to and spaced from the periphery of the exterior outer surface of a said container; and a second fastening means adapted to make removable locking engagement with the first fastening means, said second fastening means being located on the edge of the other end of the covering member and extending substantially along the width thereof and positioned to be located in a plane substantially parallel to said fastening means;

said covering member being adapted to be positioned and formed around the exterior outer surface of a said container and to be pulled tightly therearound to cause the covering member to be intimately engaged with the exterior outer surface of a said container such that said first and second fastening means engage and cooperate with each other to hold said covering member in a tight snug fitting relationship around a said container to insulate the same from the environment.

11. The formable removable insulating enclosure of claim 10 wherein said first fastening means is formed of a plurality of small hook-like removable members and said second fastening means is formed of a soft, tough extended pile-like fabric member which is adapted to be engaged by and held securely by the plurality of hook-like removable members, said hook-like removable members and said extended pile-like fabric member being adapted to engage each other in a tight clamping relationship when the hook-like removable members are urged into intimate engagement with the extended pile-like fabric member and being adapted to be separated therefrom in response to a separate force which withdraws and separates the hook-like removable members from the extended pile-like fabric member.

12. The formable removable insulating enclosure of claim 10 further comprising means defining a passageway along one elongated side of the covering member which is adapted to be positioned adjacent the top of a said container; and a typing member located within and extending from said means defining a passageway and adapted to urge the elongated edge of the covering member into tight, intimate engagement with a said container when the covering member is held in a tight snug fitting relationship around the exterior outer surface of a said container.

13. The formable removable insulating enclosure of claim 12 wherein the first fastening means and the second fastening means extend along the entire width of the covering member and wherein said means defining a passageway extends along one edge of the covering member and extends between the interior edges of the fastening means.

14. The formable removable insulating enclosure of claim 10 further comprising a first and second elongated strap extending from the edge of a selected end of the covering member and in a spaced parallel relationship to each other;

a first pair of strap fastening means one of which is located on the exterior surface of each elongated strap adjacent said selected end of the covering member and positioned on the surface of the elongated strap which is opposite to the surface of the selected end of the covering member containing one of the pair of fastening means; and a second pair of strap fastening means one of which is located on the exterior surface of the end of each elongated strap, said second pair of strap fastening means being located on the surface of each elongated strap which is on the same side as the surface of the selected end of the covering member containing one of the pair of fastening means, said first pair of strap fastening means and second pair of strap fastening means being adapted to cooperate and removably engage each other to support a said container and the enclosure from a support while the enclosure encloses a said container therein.

15. The method for enclosing a container with a removable insulating enclosure comprising the steps of positioning and forming a pliable elongated covering member including a resilient insulating layer around the exterior outer surface of a said container wherein said covering member has a width substantially equal to the height of a said container and a length which is greater than the geometrical dimension around the periphery of the exterior outer surface of a said container;

overlapping the edges of the ends of the covering member to enclose a said container to position a first fastening means located on the edge of one end of the covering member on the surface opposite to that in contact with a said container into engagement and contact with a second fastening means located on the edge of the other end of the covering member on the surface adjacent with and overlapping said one end of the covering member;

urging the first fastening means into removable locking engagement with the second fastening means to hold said covering member in a tight snug fitting relationship around a said container to insulate the same from the environment; and pulling and tying a tying member through a passageway located along the longitudinal side of the covering member adjacent the top of a said container to urge the longitudinal side of the covering member into intimate holding engagement thereagainst.

* * * * *